United States Patent [19]

Shapiro et al.

[11] 4,450,640

[45] May 29, 1984

[54] SIGN LETTER STRUCTURE

[76] Inventors: Jay B. Shapiro, 17 South Dr., Roslyn, N.Y. 11576; Willaim Bank, 3025 Ocean Ave., Brooklyn, N.Y. 11235

[21] Appl. No.: 430,483

[22] Filed: Sep. 30, 1982

[51] Int. Cl.[3] ..... G09F 7/00

[52] U.S. Cl. ..... 40/596; 40/551; 40/552

[58] Field of Search ..... 40/596, 551, 552

[56] References Cited

U.S. PATENT DOCUMENTS

| | | | |
|---|---|---|---|
| 1,006,483 | 10/1911 | Jones | 40/551 |
| 1,623,585 | 4/1927 | Fayle | 40/551 |
| 3,254,436 | 6/1966 | Bank | 40/596 |
| 3,284,889 | 11/1966 | Flitman et al. | 40/552 |
| 3,431,666 | 3/1969 | Bank | 40/552 |
| 3,675,355 | 7/1972 | Shanok et al. | 40/596 |
| 3,937,384 | 2/1976 | Minogue et al. | 40/596 |
| 4,140,405 | 2/1979 | Shapiro et al. | 40/596 |

FOREIGN PATENT DOCUMENTS

| | | | |
|---|---|---|---|
| 770864 | 11/1967 | Canada | 40/596 |
| 1091509 | 4/1955 | France | 40/552 |
| 254701 | 12/1979 | Italy | 40/551 |
| 124454 | 3/1927 | Switzerland | 40/551 |
| 122206 | 8/1927 | Switzerland | 40/551 |
| 5010 | of 1914 | United Kingdom | 40/551 |

*Primary Examiner*—Gene Mancene
*Assistant Examiner*—James Hakomaki
*Attorney, Agent, or Firm*—Morgan, Finnegan, Pine, Foley & Lee

[57] ABSTRACT

An illuminated sign letter structure made up of an extruded plastic strip having a metal foil encased therein. One end of the strip is enlarged and has a ledge projecting outwardly from the strip. The opposite sides of the ledge are parallel and smooth for receiving the edges of a letter-form. The extruded plastic strip is formed into a letter shape and a letter-form of the letter shape is fixed in the frame to engage either the inner or the outer parallel, smooth ledge side. The metal foil may be straight or the end of the foil at the enlarged end of the extruded strip may be bent inwardly into the enlarged end.

8 Claims, 4 Drawing Figures

SIGN LETTER STRUCTURE

This invention relates to sign letter structures and, more particularly, to letter structures having translucent letter-forms for mounting on an opaque sign frame usually containing a light source for illuminating the letter and desired portions of the letter structure.

In U.S. Pat. No. 3,254,436, dated June 7, 1966 and U.S. Pat. No. 4,140,405, dated Feb. 20, 1979, there are shown and described sign letter construction in which letter-forms of translucent material are mounted in a letter frame. The letter frames in both patents are made up of a metal strip, or foil, embedded in transparent plastic. When the sign is illuminated, the illumination passes forwardly through the letter-form and through pre-designated areas of the letter structure. Thus, in the U.S. Pat. No. 3,254,436, in addition to the letter-form, the light source illuminates the transparent plastic around the letter edge. In the U.S. Pat. No. 4,140,405, transparent or translucent areas are provided in the wall of the letter structure behind the letter-form to improve and enhance the attractiveness and appearance of the sign.

In the instant invention it has been discovered that the attractiveness and appearance of such sign letter structures can be further enhanced and improved and that such sign letters can be made more readily adaptable for use in the manufacture of new signs or the conversion of existing signs. Thus, as will be more fully described later herein, the sign letter structure of the instant invention might be mounted on the face of an opaque sign frame, around the edges of a letter cut-out in the sign frame or the sign letter structure might be slipped over an existing letter structure on the opaque sign frame from which the pre-existing letter face has been removed. In either event, a translucent letter-form is fixed to the face or projecting end of the letter structure, as mounted on the opaque sign frame, for illumination by the light source in the frame.

In the instant invention, as will be more fully described, the letter-form might be mounted on the letter frame from the front of the letter frame so as to rest on the outer side of an inwardly projecting ledge or protuberance on the inner wall of the letter frame or the letter-form might be mounted from the back or sign frame side of the letter so as to rest on the inner side of the ledge or protuberance. The direction from which the letter-form is mounted, i.e., from the front or from the back will affect the appearance and the edge illumination of the letter.

The invention of the instant application will be more fully described and will be better understood from the following description taken with the appended drawings, in which.

Figure 4:
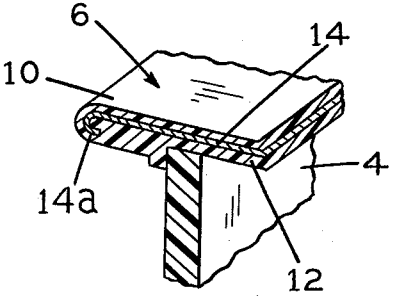
FIG. 4 is a view similar to FIGS. 2 and 3 but showing a modified form of the invention.

Referring to the drawings, the sign letter, generally designated 2, includes a generally flat, transparent or translucent letter-form in a frame, generally designated 6. Letter-form 4 may be cut or cast from a suitable transparent or translucent material, preferably, transparent or translucent plastic. The transparent or translucent material may be colorless, may be white or may be colored depending upon the design of the sign. Frame 6 is of material bent and shaped to conform to the letter frame contour. For reasons more apparent hereinafter, sign letter 2 is mounted on an opaque or translucent support 8.

Figure 2:
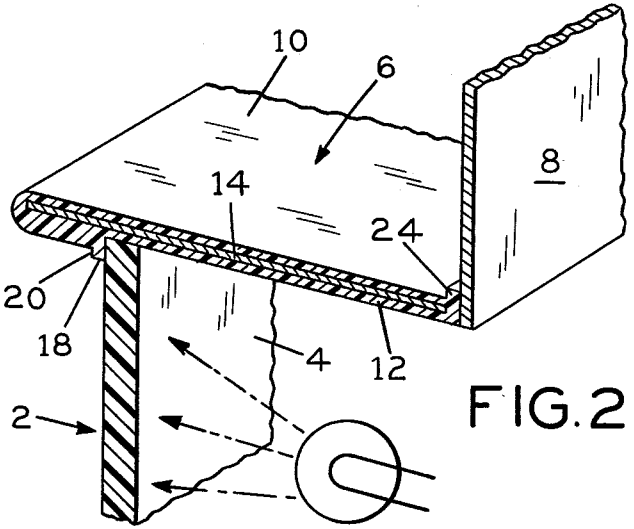
FIG. 2 is an enlarged view, in section, taken at 2—2 FIG. 1.

Referring to FIG. 2, frame 6 includes an outer ply 10, an inner ply 12 and strip 14 of metal foil or other opaque interface material positioned between and embedded in inner and outer plies 10, 12. At the forward end of frame 6, the end remote from support 8, inner ply 12 is thickened or enlarged to form enlarged outer end 16 and inwardly projecting ledge or protuberance 18 spaced inwardly from outer end 16 and having, at its outer and inner surfaces 20, 22, flat surfaces for flush engagement with the outer or inner surface of letter-form 4 for reasons more apparent later herein. At its inner end, for contact with support 8, frame 6 may be smooth or provided with an outwardly projecting ledge 24 for mounting frame 6 with letter-form 4 on support 8.

Preferably, plies 10, 12, with strip 14 therein, are extruded as a continuous strip which may be cut and formed into the letter. The continuous composite strip might be suitably mitred and grooved in order to form the desired letter shape. In any event, letter-form 4, of transparent or translucnet material, is fitted into letter frame 6 abutting ledge 18 at surface 20 or 22, as the case may be, and forming a fitted, mating inter-fit therewith. Letter-form 4 is affixed to frame 6 with a suitable cement, adhesive or solvent which fuses the letter-form and frame materials.

Figure 3:
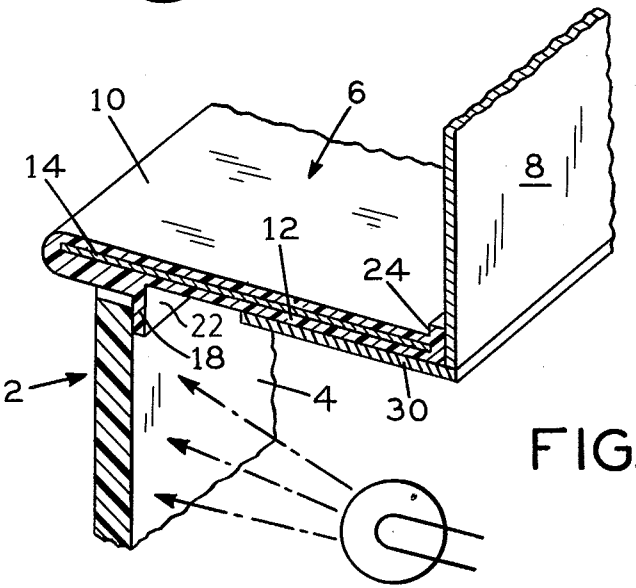
FIG. 3 is a view similar to FIG. 2 but showing the letter-form in alternate position.
Figure 1:
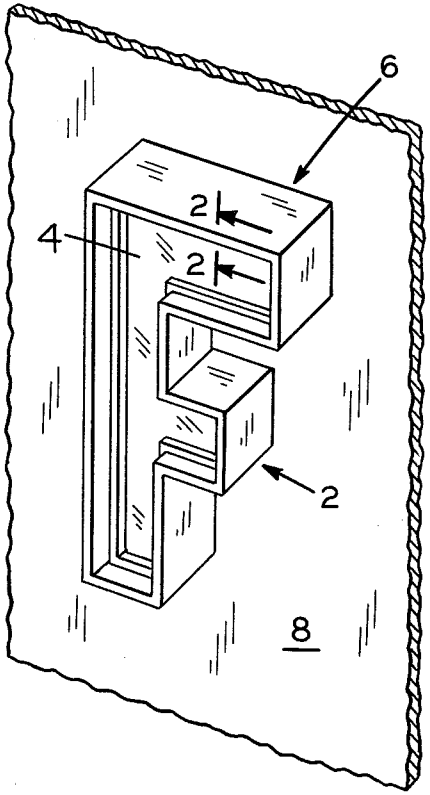
FIG. 1 is a perspective view of a letter structure embodying the invention.

Letter frame 6, after the letter has been formed and shaped, may be affixed to the face support 8 around the edge of the letter cut-out with a suitable cement, adhesive or solvent, FIG. 2, or may be sleeved over existing letter body 30, FIG. 3, affixed to face support 8 and from which the letter face has been removed and is being replaced. Letter frame 6 may be affixed to body 30 with a suitable cement, adhesive or solvent.

Letter-form 4 may be placed on the inner side of ledge 18, FIG. 2, and affixed, attached and sealed to surface 22 by a suitable cement, adhesive or solvent, or may be placed on the outer side of ledge 18, FIG. 3, and similarly affixed, attached and sealed to surface 20, FIG. 3. The placing or positioning of letter-form 4 on the inner or on the outer side of ledge 18 will, of course, change the appearance of the letter.

When positioned on the inner side of ledge 18, FIG. 2, the letter-form 4 face of the letter is recessed, will have a recessed appearance and ledge 18 around the edge of letter-form 4 and against which letter-form 4 is affixed or attached will be illuminated by the illumination of the light behind the letter illuminated through inner ply 12. Depending upon the color of letter-from 4 and the color of the transparent plastic, a halo of plain or colored light might be provided around letter-form 4, to highlight or accentuate the letter or to subdue the recessing depending upon the effect desired.

When positioned on the outer side of ledge 18 against surface 20, FIG. 3, the letter-form 4 face of the letter will have a more flush letter appearance. Indeed, the depth of the form of letter frame 6 from surface 20 of ledge 18 to the front edge of the frame as compared to the thickness of letter-form 4 can be designed and letter frame 6 can be extruded so that the front edge of frame 6 and the surface of letter-form 4 are flush or substantially flush. Because the letter-form 4 is in front of ledge 18, the illumination of the transparent plastic of ledge 18 will be behind letter-form 4 in the embodiment of FIG. 3 and will not be visible from the front of the letter.

It is to be understood that the positioning of letter-form 4 in front or in back of ledge 18 is a matter of choice and is not dependent upon the configuration of support 8. Thus, the positioning of letter-form 4 on the front of ledge 18, as in FIG. 3, can be employed with the embodiment of FIG. 2 and vice versa. Where desired the exposed or outer surface of ply 10, inwardly from the letter-form, might be painted or otherwise finished to match the surface of support 8 or to highlight the exposed letter side. Such finish might be opaque and prevent passage of illumination through the side of letter frame 6.

As shown in FIGS. 2, 3 and 4, the end of foil 14 at the enlarged end of letter frame 6 might be straight, as shown in FIGS. 2 and 3, or might be bent backward onto itself in the enlarged end of the letter frame and toward the direction of letter-form 4, as shown at 14*a*, FIG. 4. Whether letter frame 6 is formed with straight foil, as in FIGS. 2 and 3, or with bent or curved end foil, as shown at 14*a*, FIG. 4, illumination of inner ply 12 by the light source behind letter-form 4 will be transmitted by the transparent or translucent material of inner ply 12 from behind letter-form 4 to the front of the letter-form. The degree of illumination transmitted, the effect and the appearance of such transmitted illumination at the front of the letter-form will depend upon whether the foil edge is straight or bent or curved. With the edge straight, inner ply 12 around the letter-form will be illuminated. With the edge bent or curved, such as 14*a*, FIG. 4, a part of the transmitted illumination will be shielded or blocked by the curved or bent back foil. The amount of illumination shielded or blocked will, of course, depend upon the degree of the bend or curve in the foil, the width of such bend or curve and the length to which the foil is returned in the enlarged end.

The terms and expressions which have been employed are used as terms of description and not of limitation, and there is no intention, in the use of such terms and expressions, of excluding any equivalent of the features shown and described or portions thereof, but it is recognized that various modifications are possible within the scope of the invention claimed.

What is claimed is:

1. In an illuminated sign letter structure for use in a sign illuminated from a light source positioned rearward of the letter structure, a generally flat letter-form through which light can pass, a strip material bent to conform to the perimeter of said letter-form and forming a side frame therearound, said strip material comprising inner and outer plies of plastic material extruded about the opposite surfaces of a metal foil, at least the inner of said plies being of a transparent material, and an enlarged side frame end for receiving a letter-form, said metal foil in said enlarged frame end being flat between said plies and forming on the letter-form side of said frame a transparent ply area extending forwardly from the front and around the periphery of said flat letter-form and being illuminated by the illuminating source at the rear of said letter-form, said illuminated transparent ply area around the periphery of said letter-form forming an illuminated edge area in the transparent inner ply around the inner peripheral edge of the letter-form when said letter-form is illuminated from the rear and viewed from the front.

2. In an illuminated sign letter structure, as recited in claim 1, in which the end of said metal foil in said enlarged frame end is bent inwardly toward the letter-form side of said frame at the outer end of said frame end but leaving a transparent area in said inner ply abutting said letter-form and extending forwardly and outwardly therefrom, said inwardly bent metal foil at the outer end of said transparent area blocking the transmission of illumination to the outermost end of said transparent area from said illuminating source at the rear of said letter-form while permitting the transmission of illumination from said illuminating source to said transparent area in said inner ply abutting said letter-form to form said illuminated edge area in the transparent inner ply around the inner peripheral edge of the letter-form when said letter-form is illuminated from the rear and viewed from the front.

3. In an illuminated sign letter structure for use in a sign illuminated from a light source positioned rearward of the letter structure, a generally flat letter-form through which light can pass, a strip material bent to conform to the perimeter of said letter-form and forming a side frame therearound, said strip material comprising inner and outer plies of plastic material extruded about the opposite surfaces of a metal foil, at least the inner ply material being of a transparent material and forming an enlarged side frame end for receiving a letter-form, said enlarged side frame end inwardly of the edge of said strip terminating in an outwardly extending ledge, said ledge having opposite parallel surfaces for mating inter-fit with the surface of a letter-form engaged therewith, said extruded, transparent plastic material at the letter-form side of said frame extending forwardly and outwardly from said flat letter-form and being illuminated by the light source rearward of said letter-form to form said illuminated edge area in the transparent inner ply around the inner peripheral edge of the letter-form when said letter-form is illuminated from the rear and viewed from the front.

4. In an illuminated sign letter structure, as recited in claim 3, in which said strip material is formed into a letter shape.

5. In an illuminated sign letter structure, as recited in claim 4, in which a letter-form of the letter shape of said strip is mounted in said letter shaped strip with the surface at the edge of said letter-form in engagement with the outer parallel surface of said ledge.

6. In an illuminated sign letter structure, as recited in claim 4, in which a letter-form in the letter shape of said strip is mounted in said letter shaped strip with the surface at the edge of said letter-form in engagement with the inner parallel surface of said ledge.

7. In an illuminated sign letter structure, as recited in claim 4, in which said strip material formed into a letter shape is affixed to the face of a support around a letter cut-out in said support to form on said support an outwardly projecting letter conforming to the cut-out.

8. In an illuminated sign letter structure, as recited in claim 7, in which said support with said letter cut-out therein includes a letter body in the shape of said letter cut-out and projecting outwardly from said support and said strip material formed into a letter shape is sleeved over said letter body to form on said support with said letter body an outwardly projecting letter conforming to the cut-out.

* * * * *